United States Patent [19]
Schmalz et al.
[11] 4,260,002
[45] Apr. 7, 1981

[54] ROTATABLE CUTTER SPINDLE

[75] Inventors: Karl H. Schmalz, Ruedesheim; Arnold Schmidt, Gutenberg; Karl H. Ulrich, Stromberg, all of Fed. Rep. of Germany

[73] Assignee: Hombak Maschinenfabrik K.G., Bad Kreuznach, Fed. Rep. of Germany

[21] Appl. No.: 905,867

[22] Filed: May 15, 1978

[30] Foreign Application Priority Data

May 14, 1977 [DE] Fed. Rep. of Germany ..... 2721930
May 14, 1977 [DE] Fed. Rep. of Germany ..... 2721971

[51] Int. Cl.[3] ..... B27G 13/00
[52] U.S. Cl. ..... 144/230; 144/162 R; 144/174; 144/241; 407/61
[58] Field of Search ..... 144/41, 42, 218, 230, 144/240, 241, 188, 162 R, 172, 174, 323; 407/55, 61

[56] References Cited

U.S. PATENT DOCUMENTS

| | | | |
|---|---|---|---|
| 803,804 | 11/1905 | Bolton | 144/241 |
| 2,813,557 | 11/1957 | Thompson | 144/172 |
| 2,825,371 | 3/1958 | Forman | 144/41 |
| 2,898,958 | 8/1959 | Schubert | 144/172 |
| 3,319,673 | 5/1967 | Voelskow | 144/172 |
| 3,750,726 | 8/1973 | Buchacher | 144/172 X |
| 3,882,912 | 5/1975 | Sybertz | 144/42 |

*Primary Examiner*—W. Donald Bray
*Attorney, Agent, or Firm*—Michael J. Striker

[57] ABSTRACT

A rotatable cutter spindle for cutting chips of predetermined length has a supporting body having an axis, and a plurality of cutters mounted on the body in spaced relationship to one another and inclined relative to the axis of the body. Each of the cutters includes an acute angle with the axis and has a leading and a trailing end and defines cutting angles which differ from one to another of these ends. Each of the cutters has alternately arranged radially outer cutting edges and radially inner cutting edges of which the radially inner cutting edges are formed by grooves which are provided in the cutters and which have a width that increases from the leading end toward the trailing end of the cutter. The radially outer cutting edges are arranged at a first common circular surface, whereas the radially inner cutting edges are arranged at a second common circular surface.

14 Claims, 13 Drawing Figures

ROTATABLE CUTTER SPINDLE

BACKGROUND OF THE INVENTION

The present invention relates to a rotatable cutter spindle for cutting wooden chips of a predetermined length.

In order to produce flat chips of high quality it has been known for a long time to provide a cutter spindle in which a cutter is arranged on a supporting body inclined relative to the axis of the latter. In such a case, a pulling cut is performed which guarantees a wooden chip with a smooth cutting surface and a high quality upper surface. Such a cutter spindle is disclosed in the German Pat. No. 1,251,937.

In the known cutter spindles a so-called toothed cutter has been used. It is formed as a strip-shaped cutter whose radially outer portions are provided with cutting edges. Each of the toothed cutters removes a material along the region corresponding to half of the cutter length. In order to guarantee a complete material removal, the toothed cutters are offset relative to one another by half of the tooth length. The length of the chips is determined by the portion of the cutters provided with the cutting edges, so that when such cutters are utilized a splitting cutter can be abandoned which latter was necessary in the cases when cutters with continuous cutting edges were utilized.

The cutter spindles with toothed cutters inclined relative to the spindle axis have been proved to be satisfactory for manufacturing high quality flat chips for many years. The only adherent disadvantages thereof are constituted by the fact that they have relatively small material removal capacity inasmuch as in order to cut over the entire length of the cutter spindle it is necessary to have two cutters, and that the number of the cutters to be mounted to the cutter spindle is limited on construction grounds. Purely theoretically it is possible to double the material removal capacity for a given cutter spindle, when the toothed cutter can be replaced with a cutter with continuous cutting edges. However, a splitting cutter which has to be provided in such a case occupies an additional space. The splitting cutter is expensive and involves expensive manipulations for insertion of the same into the cutter spindle inasmuch as this cutter, similarly to the chip cutter, becomes quickly blunted and as a rule must be replaced by a new one. Moreover, the splitting knife affects the desirable support of wood before the chip cutter and increases the separation of the material.

Some other cutter spindles are disclosed in the German Design Patent MR No. 52 published in 1957, in the German Pat. Nos. 936,294 and 2,241,938, and in the German Auslegeschrift Nos. 1,021,565 and 1,076,936.

SUMMARY OF THE INVENTION

Accordingly, it is an object of the present invention to provide a rotatable cutter spindle for cutting chips of a predetermined length, which avoids the disadvantages of the prior art.

More particularly, it is an object of the present invention to provide a rotatable cutter spindle which has an improved material removal capacity and provides for manufacturing chips of higher quality, as compared with the known cutter spindles.

In keeping with these objects, and with others which will become apparent hereinafter, one feature of the present invention resides, briefly stated, in a rotatable cutter spindle which has a plurality of cutters mounted on a supporting body in spaced relationship to one another and inclined relative to the axis of the body so that each of the cutters includes an acute angle with the axis and has a leading end and a trailing end and defines cutting angles which differ from one to another of these ends. Each of the cutters has alternately arranged radially outer cutting edges and radially inner cutting edges of which the radially inner cutting edges are formed by grooves which are provided in the cutters and which have a depth which increases from the leading end toward the trailing end of each cutter. The radially outer cutting edges are arranged at a first, circular surface, and the radially inner cutting edges are arranged at a second common circular surface.

In this construction, since the grooves forming the radially inner cutting edges have a depth that increases from the leading end toward the trailing end of the cutter, they compensate for the inclined position of the cutter and the differing cutting angle resulting in differing radial extension of the inner cutting edges. The required depth of the grooves depends upon the radius of the cutter spindle, the length of the cutter spindle or the length of the cutter, the angle of the bevel cut as well as the cutting angle. The depth of the grooves can be relatively easily diametrically determined, as will be seen hereinbelow.

The invention provides for a considerable increase of cutting capacity as compared with the known cutter spindles, with maintaining the advantages resulting from inclined position of the cutter. The cutter in accordance with the present invention can be relatively easily manufactured inasmuch as simple and precise grinding of the grooves can be performed by an automatic grinding machine. It is further essential that finish grinding of the cutter can be performed by conventional surface grinding machines so that the radial outer cutting edges and radial inner cutting edges can be simultaneously grinded without changing the distance between the cutting edges. The grooves may be so dimensioned that a groove located at the leading end of the cutter has a minimum depth whereas a groove located at the trailing end of the cutter has a maximum depth.

Another feature of the present invention is that each of the cutters has a chip groove which is subdivided into at least two pockets by a partition extending normal to the axis of the supporting body and having a radially outer edge which lies on a circumferential surface of the supporting body. Each of the cutters may have a front surface, and a projection may be provided which extends from the partition to this front surface of a respective one of the cutters and has a width reducing toward the front surface.

In accordance with still another advantageous feature of the present invention, each of the pockets and each of the outer cutting edges extend over a portion of respective ones of the cutters, which portion is located adjacent to the partition, and the projection of the partition is in alignment with an interface between the outer cutting edge and an adjacent one of the inner cutting edges.

In accordance with a further feature of the present invention, the projection has a flank which faces toward the outer cutting edge and is in alignment with a wall of the partition. This flank also lies in a plane which is normal to the axis of the supporting body. This provides for optimal conditions for running of the chips, and a dynamic pressure of chips in this critical region of the pockets is eliminated.

In accordance with a still further feature of the present invention, each cutter is mounted on a holding member which has a filling piece engaged in the groove of the front surface of the cutter. The holding member may carry a projection and may be provided with a chip guiding surface forming an extension of the pocket. The chip guiding surface may merge in a stepped manner into the outer cutting edges and the inner cutting edges of the cutter.

The filling piece overlaps the projection when the latter engages in a further groove provided in the holding member, and arrests the projection in the latter. The securing means engages the holding member and secures the filling piece to the latter.

In accordance with an additional feature of the present invention the supporting body of the cutter spindle has a stepped surface including portions having a greater diameter at the outer cutting edges and portions having a smaller diameter at the inner cutting edges. The outer and inner diameters may be spaced from one another by a distance which is equal to a distance between the first common surfaces and the second common surfaces at which the radially outer cutting edges and the radially inner cutting edges are arranged, respectively.

A yet another feature of the present invention is that the partition between the pockets may be inclined relative to the axis of the supporting body. In such a construction the partition somewhat deviates in the direction of an angle which is included between the axis of the supporting body and the cutter. By this, natural movement of the chip is enhanced. Moreover, a surface for supporting a wooden material to be cut, is increased.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 3:
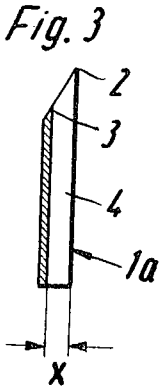
FIG. 3 is a view showing a section taken along the line III—III in FIG. 2.
Figure 1:
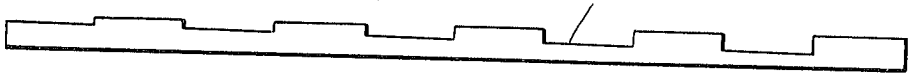
FIG. 1 is a top view of a cutter of a rotatable cutter spindle in accordance with the present invention.
Figure 2:
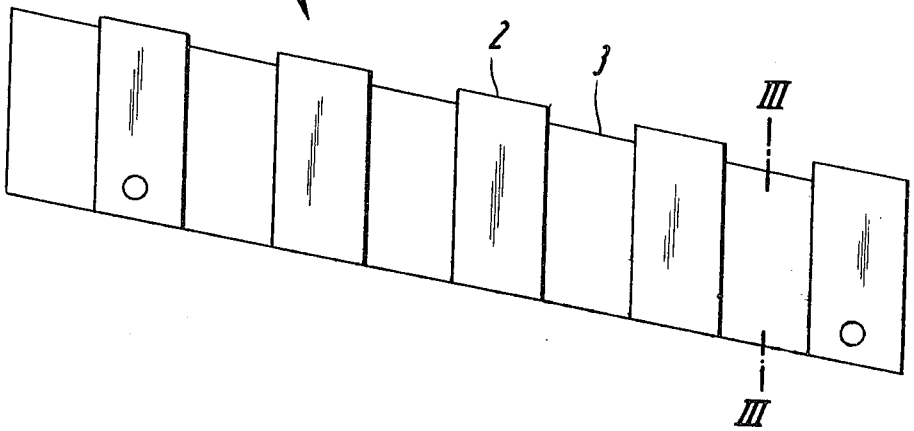
FIG. 2 is a view showing a front surface of the cutter shown in FIG. 1.

FIGS. 1 and 3 shows a cutter 1 of a rotatable cutter spindle for cutting chips of a predetermined length in accordance with the present invention. The cutter 1 is strip shaped and has alternately arranged radially outer cutting edges 2 and radially inner cutting edges 3. The cutting edges 2 and 3 follow immediately one after another so that the cutter 1 performs material removal work over its entire length.

The radially inner cutting edges 3 are formed by grooves 4 which are provided in a front surface 1*a* of the cutter and may be manufactured by grinding. The grooves 4 of a single cutter have a differing depth which is identified by reference letter x. As can be seen from FIG. 3, the cutting edges 2 and 3 do not jointly lie in a plane which is formed by the front surface 1*a* of the cutter.

Figure 4:
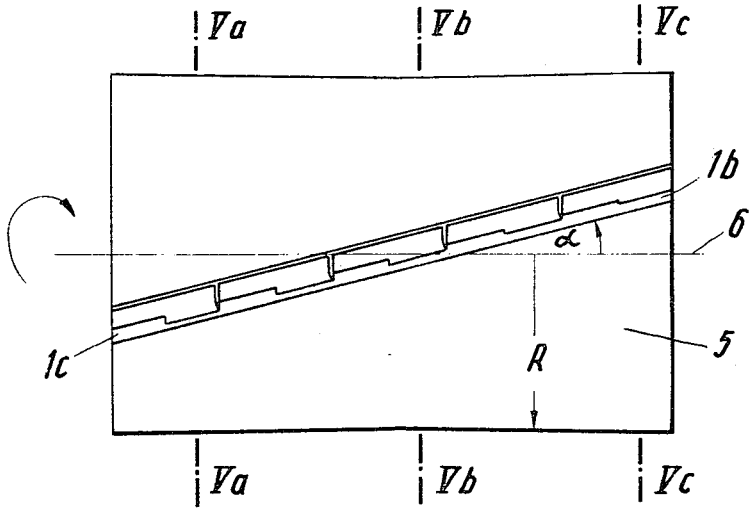
FIG. 4 is a schematic view showing the cutter spindle in accordance with the present invention; which includes a supporting body and a cutter inclined relative to an axis of the body.

The cutter spindle is shown in FIG. 4 and includes a supporting body of substantially cylindrical shape 5 on which the cutter 1 is mounted in an inclined position relative to an axis 6 of the supporting body 5. The cutter 1 includes an acute angle $\alpha$ with the axis 6 of the supporting body 5. Taken into the consideration the direction of rotation which is identified by the arrow in FIG. 4, the right end 1*b* of the cutter forms a leading end thereof, whereas the left end of the cutter 1*c* forms a trailing end thereof.

Figure 5:
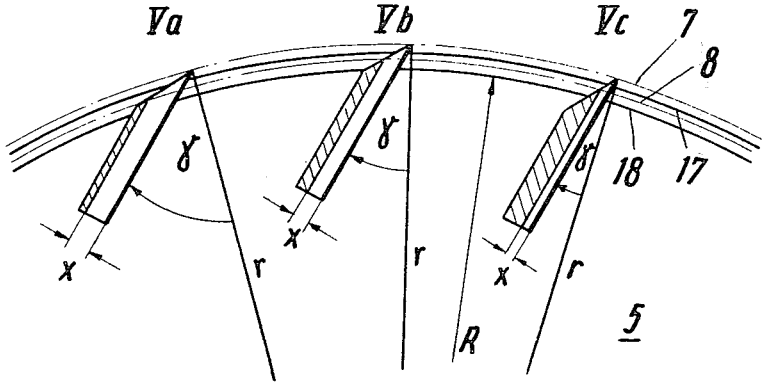
FIG. 5 is a view showing several sections of the cutter spindle taken along lines Va—Va, Vb—Vb, and Vc—Vc in FIG. 4.

FIG. 5 shows three sections taken through one of the cutters. The left section shown in FIG. 5 is a section taken in the trailing end 1*c*, the central section is a section taken somewhat in a central region of the cutter, and the right section is a section taken in the leading end 1*b*. The cylindrical radius of the supporting body 5 is identified by reference letter R, an outer circular surface or orbit at which the radially extending outer cutting edges 2 are arranged is identified by reference number 7, and the inner circular surface or orbit at which the radially extending inner cutting edges 3 are arranged is identified by reference number 8. Reference letter $\gamma$ identifies an angle included between the front surface 1*a* of the cutter and a radius r lying at the outer cutting edges 2 (a cutting angle).

In order to attain an identical cutting depth, all inner cutting edges 3 must be located at the same inner circular surface 8. This is guaranteed by corresponding depth x of the grooves 4 which are shown in FIG. 5 in correct scale. The successively positioned grooves 4 of a single cutter have a varying depth that increases from the leading end 1*b* toward the trailing end 1*c* of the cutter. The groove located at the leading end 1*b* has a minimum depth whereas the groove located at the trailing end 1*c* has a maximum depth.

Figure 7:
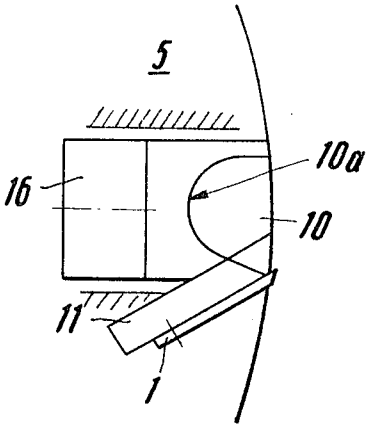
FIG. 7 is a side view of the elements shown in FIG. 6.
Figure 6:
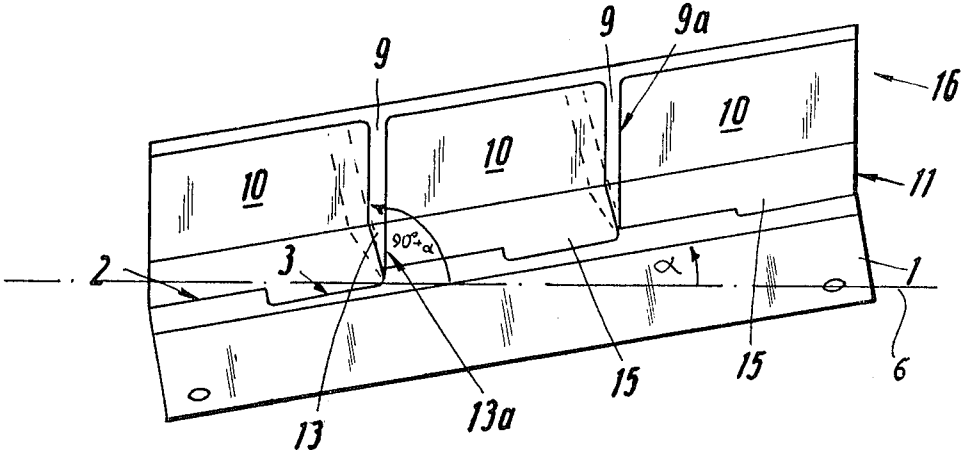
FIG. 6 is a plan view showing a member forming chip pockets, a cutter holding member, and a cutter.

As can be seen from FIGS. 6 and 7, a member 16 is movably mounted in the cylindrical supporting body 6 of the cutter spindle and a cutter holding member 11 to support the cutter 1 is mounted on the body 5 so that a chip groove 10*a* is provided therebetween. The chip groove is subdivided into chip pockets 10 by partitions 9. Each of the pockets 10 extends over a distance corresponding to two portions of the cutter. Each partition 9 lies in a plane which is normal to the axis 6 of the supporting body, and a radially extending outer edge of the partition lies in a circumferential surface of the cutter spindle.

Each cutter 1 is mounted by its front surface 1*a* on a cutter holding member 11. The latter is provided with the correspondingly dimensioned filling piece 12 which engages in the groove 4 of the front surface of the cutter. The holding member 11 carries outer projections 13 which correspond to the paritities 9 and extend to the front surface of the cutter. Each of the projections 13 has a reduced cross section and a thinned end which is located in alignment with an interface between the outer cutting edge 2 and the inner cutting edge 3. Thus, the portion of the cutter corresponding to the pocket 10 and the radially outer cutting edge 2 are extended toward the partition 9. A flank 13*a* of the projection 13 which faces toward the radially outer cutting edge 2 is located in alignment with the adjacent wall 9*a* of the partition 9. The filling pieces 12 are used for fixing the projection 13 of the cutter holding member 11.

Figure 9:
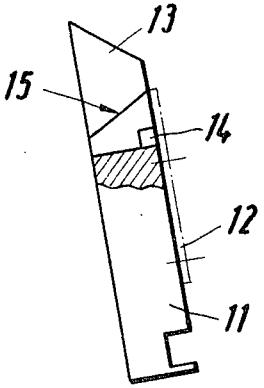
FIG. 9 is a side view of the cutter holding member shown in FIG. 8.
Figure 8:
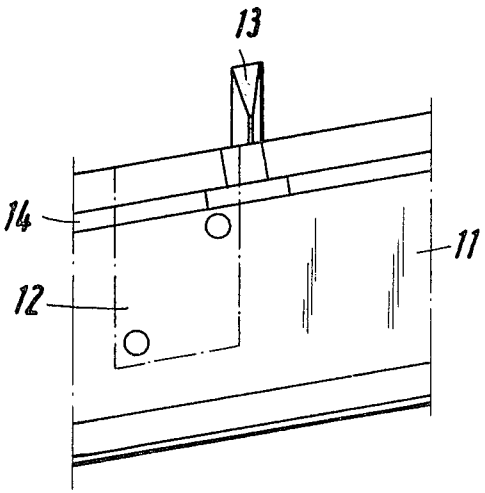
FIG. 8 is a rear view of the cutter holding member.

FIGS. 8 and 9 show that the projections 13 can be replaceably mounted on the holding member 11. The projection engages in a groove 14 of the holding member 11 and is arrested in this position by the filling piece 12 which overlaps the projection and is shown in dotted lines. The projection 13 is subjected to wear in operation and is constituted by a wear resistance material.

Figure 10:
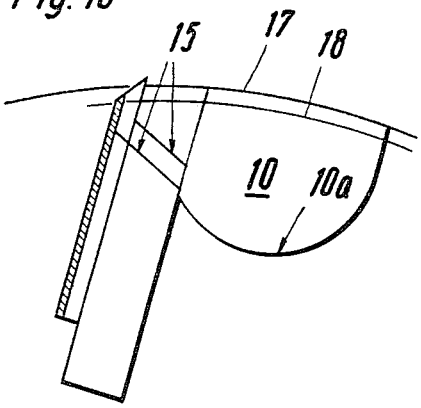
FIG. 10 is a view showing a section of the cutter and the cutter holding member.
Figure 11:
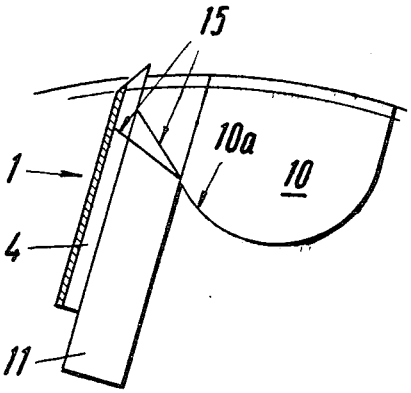
FIG. 11 is a view corresponding to the view shown in FIG. 10 by illustrating another embodiment of the present invention.

FIGS. 10 and 11 show different embodiments of a chip guiding surface 15 between the projections 13. The chip guiding surface 15 merges into a bottom 10*a* of the pocket 10. The chip guiding surfaces 15 may merge into the radially outer and inner cutting edges in a stepped manner.

Figure 12:
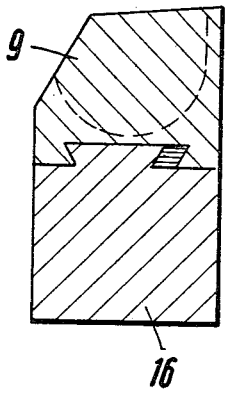
FIG. 12 is a view showing a section taken along the line XII—XII in FIG. 13.
Figure 13:
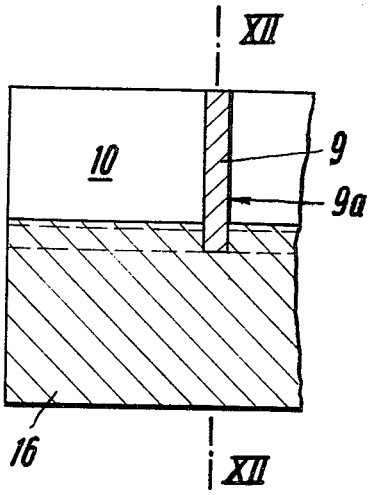
FIG. 13 is a section of the member forming chip pockets.

The partitions 9 as well as the pockets 10 formed thereby are arranged in a member 16 shown in FIG. 7 which is subjected in operation to the action of centrifugal forces and acts upon the holding element 11. As shown in FIGS. 12 and 13, the partitions 9 can be also formed as replaceable wear resistant members.

The supporting body 5 of the cutter spindle in accordance with the invention is stepped and has portions having an outer diameter 17 at the outer cutting edges 2 and an inner diameter 18 at the inner cutting edges 3. A difference between the outer diameter 17 and the inner diameter 18 may be equal to a distance between the circular surfaces 7 and 8 at which the outer cutting edges 2 and the inner cutting edges 3 are arranged respectively. This is shown in FIGS. 5, 10 and 11 of the drawing.

It is also possible that the partition 9 between the pockets 10 is inclined relative to the axis 6 of the supporting body 5 as shown in dotted lines in FIG. 6. In such a construction the partition 9 somewhat deviates in the direction of the angle $\alpha$ between the cutter 1 and the axis 6. In this case natural movement of the chip is enhanced, and a supporting surface for a material to be cut is increased.

It will be understood that each of the elements described above or two or more together, may also find a useful application in other types of constructions, differing from the types described above.

While the invention has been illustrated and described as embodied in a rotatable cutter spindle for cutting wooden chips of a predetermined length, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotatable cutter spindle for cutting chips of a predetermined length, comprising: a support body having an axis of rotation and a circumferential surface; and a plurality of like, elongated cutters mounted on said body and spaced apart relative to one another, the cutters being inclined relative to said axis, each cutter having a leading end and a trailing end and defining cutting angles which differ from one to another of said ends, and each cutter further having alternately arranged outer cutting edges extending radially outwardly from said surface and alternately arranged inner cutting edges extending radially inwardly from said surface, said inner cutting edges bounding grooves located intermediate said outer and inner cutting edges, each of said grooves having a varying depth, which varying depth increases from said leading end towards said trailing end of each cutter, said outer cutting edges lying in an imaginary first cylindrical surface and said inner cutting edges lying in an imaginary second cylindrical surface to thereby obtain an identical cutting depth.

2. The cutter spindle defined by claim 1, further comprising a plurality of elements which are each associated with a corresponding cutter, each element having a chip groove which is subdivided into at least two pockets by a partition, the partition extending normally with respect to said axis and having an outwardly extending edge, said outwardly extending edge lying along the circumferential surface of said support body.

3. The cutter spindle defined by claim 2, wherein each of the cutters has a front surface, and wherein the cutter spindle further includes a plurality of projecting members each extending from a partition towards said front surface of a corresponding cutter, with each projecting member having a width that decreases as the projecting member approaches said front surface.

4. The cutter spindle defined by claim 3 wherein: each cutter edge extends towards its corresponding partition; and each projecting member is aligned with an interface between said outer cutting edge and an adjacent inner cutting edge.

5. The cutter spindle defined by claim 4, wherein the cutter further includes a plurality of holding members, each mounted on the front surface of a corresponding cutter and having a filling piece engaging the grooves thereof, said grooves being formed on said front surface.

6. The cutter spindle defined by claim 5, wherein said holding members carry said projecting members and have chip guiding surfaces, which chip guiding surfaces form extensions of said pockets.

7. The cutting spindle defined by claim 6, wherein said chip guiding surfaces merge stepwise into said outer cutting edges and inner cutting edges.

8. The cutting spindle defined by claim 6, wherein said projecting members are detachably mounted on said holding members.

9. The cutting spindle defined by claim 6, wherein each holding member has a further groove in which a corresponding projecting member is engaged and arrested.

10. The cutter spindle defined by claim 9, wherein each filling piece overlaps a corresponding projecting member when said projecting member is engaged and arrested in said further groove.

11. The cutter spindle defined by claim 10, further including a plurality of securing means each engageable with a corresponding holding member and securing a corresponding filling piece thereto.

12. The cutter spindle defined by claim 2, wherein said elements are movably mounted on the cutter spindle and are movable by centrifugal force resulting from cutter spindle rotation.

13. The cutter spindle defined by claim 12, further including a plurality of means for detachably securing each partition in its corresponding element whereby worn-out partitions can be removed and replaced with unworn partitions.

14. The cutter spindle defined by claim 1, wherein said support body is stepped and has a larger diameter at said outer cutting edges and a smaller diameter at said inner cutting edges, the larger diameter and the smaller diameter being separated by a distance equal to a separation distance between the imaginary first and second cylindrical surfaces.

* * * * *